US005147978A

United States Patent [19]

Northrup et al.

[11] Patent Number: 5,147,978

[45] Date of Patent: * Sep. 15, 1992

[54] MAIN PROPELLANT IGNITION LINER FOR CASED TELESCOPED AMMUNITION

[75] Inventors: James R. Northrup; Brian B. Tasson, both of Maple Grove, Minn.

[73] Assignee: Alliant Techsystems Inc., Edina, Minn.

[ * ] Notice: The portion of the term of this patent subsequent to Sep. 17, 2008 has been disclaimed.

[21] Appl. No.: 747,011

[22] Filed: Aug. 19, 1991

Related U.S. Application Data

[63] Continuation of Ser. No. 580,391, Sep. 10, 1990, Pat. No. 5,048,422.

[51] Int. Cl.[5] ..... F42B 5/045

[52] U.S. Cl. ..... 102/434; 102/443

[58] Field of Search ..... 102/430, 431, 433, 434, 102/443, 439, 700

[56] References Cited

U.S. PATENT DOCUMENTS

| | | | |
|---|---|---|---|
| 117,388 | 7/1871 | Crary | 102/443 |
| 390,232 | 10/1888 | Hurst | 102/443 |
| 3,645,206 | 2/1972 | Quinlan et al. | 102/433 |
| 3,732,819 | 5/1973 | Quinlan et al. | 102/433 |
| 3,823,668 | 7/1974 | Remaly et al. | 102/433 |
| 3,847,081 | 11/1974 | Quinlan et al. | 102/431 |
| 4,197,801 | 4/1980 | Lafever et al. | 102/434 |
| 4,335,657 | 6/1982 | Bains | 102/443 |
| 4,604,954 | 8/1986 | Clarke et al. | 102/434 |
| 4,715,284 | 12/1987 | Hendry et al. | 102/434 |
| 4,846,069 | 7/1989 | Tasson et al. | 102/434 |
| 5,048,422 | 9/1991 | Northrup et al. | 102/434 |

FOREIGN PATENT DOCUMENTS

| | | | |
|---|---|---|---|
| 1330198 | 5/1963 | France | 102/443 |

*Primary Examiner*—Harold J. Tudor

*Attorney, Agent, or Firm*—Whitham & Marhoefer

[57] ABSTRACT

A cased telescoped ammunition in which a rigid liner fills the gap between the control tube and the metering tube. The liner comprises an energetic material which transfers the ignition stimulus from the control tube propellant to the main propellant. Energetic materials in the liner an be modified to increase the ignition stimulus for proper cold round performance or decrease ignition stimulus for an improved timed sequencing of the round's performance. Both double-based and single-based energetic materials may be used.

1 Claim, 3 Drawing Sheets

MAIN PROPELLANT IGNITION LINER FOR CASED TELESCOPED AMMUNITION

This application is a continuation of application Ser. No. 07/580,391, filed Sep. 10, 1990, now U.S. Pat. No. 5,048,422 entitled "Main Propellant Ignition Liner for Cased Telescoped Ammunition".

BACKGROUND OF THE INVENTION

1. Field of the Invention

This invention relates to cased telescoped ammunition, and more particularly to an improved ammunition of this type which is inexpensive to manufacture, accommodates the use of high energy main propellants, and provides control of main propellant ignition.

2. Description of the Prior Art

A typical design for cased telescoped ammunition is shown in FIG. 1. It comprises a cylindrical rolled steel casing 10 enclosing a bullet 14. A control tube 16 extends aft from roughly the midpoint of the casing 10. A granular propellant 18 is housed in the control tube 16 and upon initial ignition forces the bullet out of the casing. The control tube 16 includes a recess 20 into which fits a primer. A metering tube 22 is disposed from roughly the midpoint of the casing, forward, leaving an angular gap 24 through which propellant 18 ignites a solid main propellant 26 which surrounds the control and metering tubes. A base seal 28 and a front seal 30 secure the case to the metering tube and the control tube, respectively. In operation, the primer ignites the propellant 18 in the control tube which causes the bullet 14 to move forward. As the bullet moves forward, the expanding gas from propellant 18 ignites the main propellant 26 through the gap 24 between the control tube and the metering tube.

While generally satisfactory, cased telescoped ammunition of the type just described requires a solid molded main propellant in order to prevent the propellant from entering the cavity through which the bullet passes. Forming the solid propellant is a labor intensive and costly process. Further the use of molded solid propellants prevents the use of certain desirable high-energy propellants which cannot be readily molded.

SUMMARY OF THE INVENTION

An object of this invention is the provision of a cased telescoped ammunition which does not require a solid main propellant making it less costly to manufacture and further allowing the use of high-energy propellants which cannot be readily molded. A further object of the invention is to provide a means of controlling main tube propellant ignition.

Briefly, this invention contemplates the provision of a cased telescoped ammunition in which a rigid liner fills the gap between the control tube and the metering tube. The liner comprises an energetic material which transfers the ignition stimulus from the control tube propellant to the main propellant. Energetic materials in the liner can be modified to increase the ignition stimulus for proper cold round performance or decrease ignition stimulus for an improved timed sequencing of the round's performance. Both double-based and single-based energetic materials may be used.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
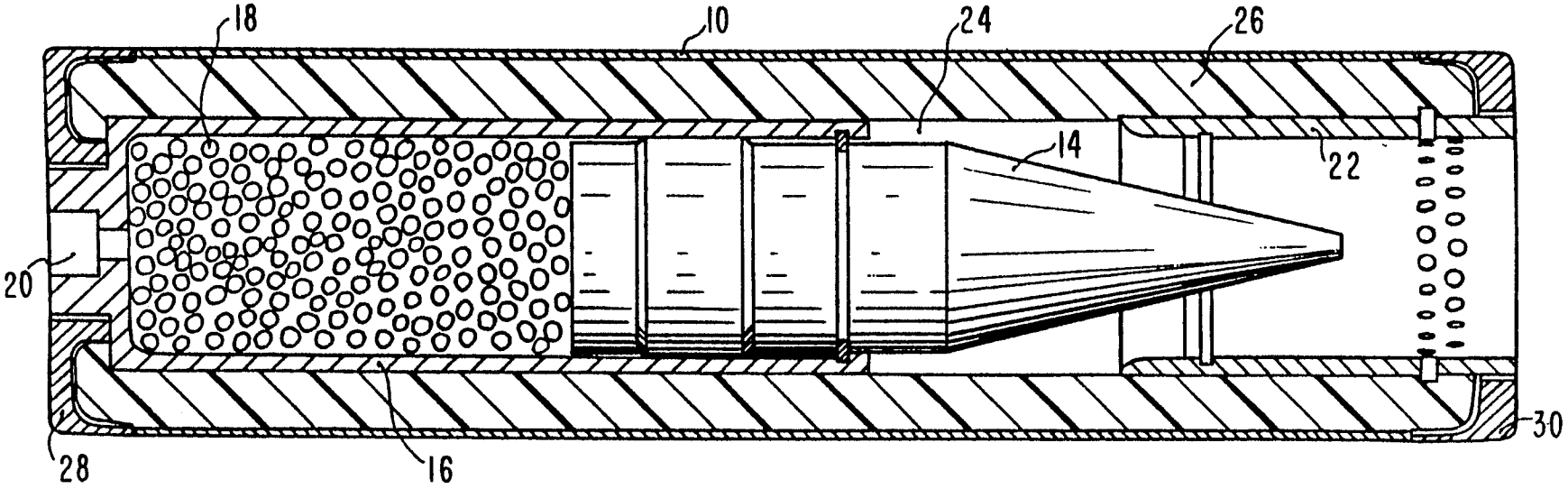
FIG. 1 PRIOR ART
FIG. 1 is a cross-sectional view of a cased telescoped ammunition of conventional design.
Figure 2:
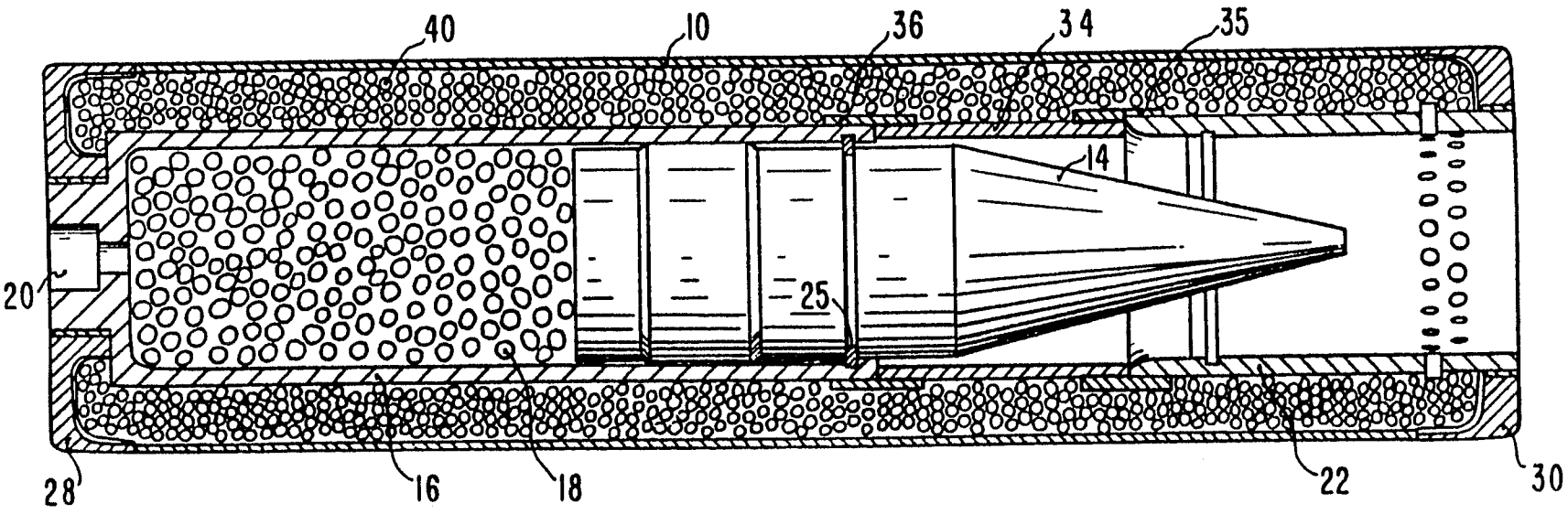
FIG. 2 is a cross-sectional view of a cased telescoped ammunition in accordance with the teachings of this invention.

Referring now to the drawings, FIG. 1 has been explained in connection with the background of this invention. FIG. 2 shows a cased telescoped ammunition in accordance with the teachings of this invention. It is generally similar to the round shown in FIG. 1 and like reference numerals have been used to identify like components in the two drawings. Like the round shown in FIG. 1 the round in FIG. 2 has an outer cylindrical case 10 of cold rolled steel or other suitable material. A control tube 16 and a metering tube 22 are disposed within the case 10 and secured to the case respectively by a base seal 28 and a front seal 30. The control tube 16 has a recess 20 into which fits a primer.

A bullet 14 is fully surrounded by the case 10 and is supported in the control tube by pressure sealing ridges 25. A rigid cylindrical liner 34 fits between the metering tube and the control tube and is aligned with the tubes by an aft guide ring 36 and a forward guide ring 34.

A bulk granular propellant 18 fills the control tube aft of the bullet 14. A bulk granular main propellant 40 fills the space between the case 10 and the control tube 16, metering tube 22, and liner 34. It will be appreciated the liner 34 which physically separates the main propellant from the bullet cavity, allows the use of a bulk loaded granular propellant.

Figure 3:
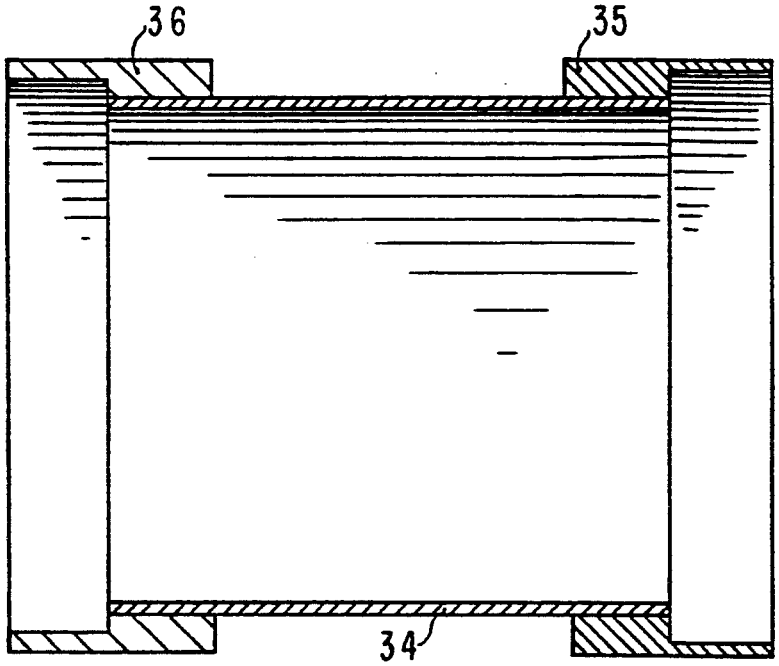
FIG. 3 is a detail view of one specific embodiment of a liner for use in the practice of the invention.

Referring now to FIG. 3, the liner 34 is a cylinder made of a suitable single or double-based energetic material combined with a moldable bonding material or with a web material. The liner 34 may advantageously have small holes or perforations distributed uniformly over its surface. Any holes or perforations are smaller than the grain size of the main propellant 40. The guide rings 35 and 36 may be adhesively bonded to the liner 34. Suitable materials for the guide rings include Nylon 6/6 and Acetal.

The guide rings 35 and 36 may also be eliminated. The liner 34, control tube 16, and metering tube 22 can be modified to structurally support the liner without guide rings. An adhesive bonding material can be added to this interface for increased rigidity.

The liner 34 comprises an energetic material held together by a binder. The term single based refers to a composition containing one energetic nitrated ester material such as nitrocellulose. A double-based composition contains two energetic nitrated esters such as nitrocellulose and nitroglycerine. Typical nitrated esters applicable to this invention include:

Nitrocellulose
Nitroglycerin
Dinitrotoluene
Diethylglycol Dinitrate
BTTN

Other suitable energetic materials include, but are not limited to:

Boron Potassium Nitrate
Oxite

Black Powder
Benite
Potassium Nitrate
Potassium Sulfate
Potassium Perchlorate
Pyrotechnic Compositions
Nitramines
Suitable binders include:
Nitrocellulose
Cellulose Acetate Butyrate
Glycidyl Azide Polymer
Thermoplastic Elastomers The percentage and type of energetic materials used in the liner composition determine the ignition timing and stimulus supplied to the main propellant. This can be used to greatly enhance the performance of the cased telescoped round, especially at cold temperature. In addition, it should be noted that an inert liner, such as a paper tube, may also be used in certain applications where it is desired to retard ignition of the propellant surrounding the tube.

The liner can be formed in any suitable manner such as by spiral wrapping sheets of material, molding the composition under heat or pressure, or by extrusion. Energetic materials are impregnated into the binder during the liner forming process. The liner thickness and manufacturing process can be varied to further modify liner combustion and structural characteristics.

An example of a single-based liner design is a liner containing 72% Grade A, nitrocellulose which has been impregnated with 2% black powder during paper manufacture. The nitrocellulose is spiral wrapped on a mandrel with the overlapping edges being adhered together with Durolock Resin to form the liner. This single base liner is fairly slow burning and leads to good main propellant ignition due to the hot particles associated with the black powder.

An example of a double-based liner design is the addition of 43% nitroglycerine to 52% nitrocellulose. The composition can be extruded and cut to the desired liner shape. The nitroglycerine significantly increases the energy content of the liner allowing for increased ballistic performance. The burn rate of the liner is also increased.

An example of molded liner is a liner prepared from nitrocellulose fiber, water, Durolock resin, and other fibers with the nitrocellulose fibers comprising approximately 78% of the mixture. The mixture is molded using conventional techniques to the desired form under heat and pressure, and the process is completed by drying. This molded liner will burn very similarly to the spiral wrapped single-based liner described above. The advantages of this molded design over the spiral wrapped is its adaptability to production quantities and eliminated adhesive bond surfaces.

While the invention has been described in terms of a single preferred embodiment, those skilled in the art will recognize that the invention can be practiced with modification within the spirit and scope of the appended claims. For example, although the invention is particularly advantageous in that it allows use of a granular propellant surrounding the control tube, a liner of the type disclosed herein may also be used in combination with a solid propellant surrounding the control tube. In this application the liner serves to control main propellant ignition to provide either an increased or decreased ignition stimulus depending upon a desired characteristic of the main propellant ignition.

Having thus described our invention, what we claim as new and desire to secure by Letters Patent is as follows:

1. A cased telescoped ammunition comprising in combination:

a imperforate control tube with an axial passageway housing a projectile and a first propellant disposed in said housing on one side of said projectile;

an outer casing surrounding said control tube and radially spaced therefrom;

a second propellant in the space between said control tube and said outer casing;

a tubular liner made of an energetic material disposed so that it contacts and extends along said passageway from an end of said control tube on the other side of said projectile and separates said second propellant from said passageway; and said control tube, said projectile and said tubular liner arranged so that ignition of said first propellant forces said projectile along said axial passageway and ignition products of said first propellant ignite said second propellant by way of said liner made of an energetic material after said projectile passes the end of the control tube.

* * * * *